US008136476B2

(12) United States Patent
LeFevre et al.

(10) Patent No.: US 8,136,476 B2
(45) Date of Patent: Mar. 20, 2012

(54) LIQUID LAYER APPLICATOR ASSEMBLY

(75) Inventors: Jason LeFevre, Penfield, NY (US); Alexander J. Fioravanti, Penfield, NY (US)

(73) Assignee: Xerox Corporation, Norwalk, CT (US)

( * ) Notice: Subject to any disclaimer, the term of this patent is extended or adjusted under 35 U.S.C. 154(b) by 914 days.

(21) Appl. No.: 12/176,023

(22) Filed: Jul. 18, 2008

(65) Prior Publication Data

US 2010/0012023 A1 Jan. 21, 2010

(51) Int. Cl.
*B05C 5/02* (2006.01)

(52) U.S. Cl. .... 118/410; 118/413; 118/429; 118/DIG. 4

(58) Field of Classification Search ..... 118/203, 118/410, 413, 429, DIG. 4; 399/346, 350; 15/256.5, 256.51; 162/281; 101/157, 169, 101/365

See application file for complete search history.

(56) References Cited

U.S. PATENT DOCUMENTS

| | | | | |
|---|---|---|---|---|
| 4,009,657 | A * | 3/1977 | Bonanno et al. | 101/157 |
| 5,380,769 | A | 1/1995 | Titterington et al. | |
| 5,808,645 | A | 9/1998 | Reeves et al. | |
| 5,928,460 | A * | 7/1999 | Miller et al. | 156/332 |
| 6,431,703 | B2 | 8/2002 | Rousseau et al. | |
| 6,921,064 | B2 | 7/2005 | Rousseau | |

* cited by examiner

*Primary Examiner* — Laura Edwards

(74) *Attorney, Agent, or Firm* — Maginot, Moore & Beck, LLP

(57) ABSTRACT

A drum assembly in a printing machine comprises a rotating drum having a surface and an applicator assembly for applying oil onto the surface. The applicator assembly includes a liquid supply containing a supply of oil, a distributor connected to the liquid supply for distributing the oil, and an applicator having an area for receiving oil from the distributor and an application edge. The distributor and the applicator are configured so that oil distributed on the area of the applicator forms a meniscus at the application edge. The application edge is positioned closely adjacent but not in contact with the surface of the drum at a distance sufficiently close to the surface so that the surface contacts the meniscus to withdraw oil from the applicator onto the surface.

36 Claims, 3 Drawing Sheets

LIQUID LAYER APPLICATOR ASSEMBLY

TECHNICAL FIELD

The present disclosure relates to devices for applying a liquid layer to a surface, such as for application of oil to a rotating drum of a printing machine.

BACKGROUND

Some printing or imaging machines using an imaging or transfer drum require the application of a liquid intermediate transfer layer. For instance in some liquid ink jet printers, a print head ejects drops of ink onto the liquid intermediate transfer layer to form an image thereon. The receiving substrate, such as paper, is brought into contact with the drum, and more particularly with the transfer layer, so that the ink is transferred from the layer onto the substrate. The intermediate transfer layer is thus formed of a material, such as a release oil, that holds the ink drops as the drum rotates but readily releases the drops onto the receiving substrate as the substrate passes between the transfer drum and an opposing pressure roll.

Imaging or printing machines using a liquid intermediate transfer layer thus require some sort of applicator assembly for metering the fluid onto the drum surface. One such assembly includes a felt wicking pad that is continuously impregnated with a liquid, such as a release oil. The wicking pad contacts the imaging surface of the drum to transfer the liquid onto the surface of the drum. Excess liquid is skimmed off the drum surface by a downstream wiper blade.

Any element contacting the rotating drum is susceptible to contamination from ink dots, paper dust, clay and the like. The contaminations build up on the contacting element until its performance is significantly degraded, which can ultimately lead to compromised images on the receiving substrate. One school of thought has suggested that increasing the supply or release agent or oil to the surface of the rotating drum will reduce the propensity for contaminants to build up on the contacting elements, such as the wiper blade. The high oil supply rates necessary to achieve this beneficial result can be problematic for traditional wicking systems. The wicking pad relies upon internal capillary action to convey the oil from the source to the application edge of the pad. In most wicking pads, the capillary capability of the pad is limited and insufficient to achieve the necessary oil supply rates. Moreover, over time the capillaries of the wicking pad can become clogged with contaminants extracted from the rotating drum as well as from the liquid source.

High speed imaging and printing requires high supply rates for the liquid intermediate transfer layer onto a high speed rotating drum. The necessary high supply rates are extremely taxing to the current conventional wicking pad technology. Moreover, the presence of contaminants in any imaging or printing system means that the applicator assembly components will require more frequent cleaning as greater numbers of image transfers are performed. Eventually, cleaning of the applicator assembly components is insufficient to restore the performance of the applicator assembly, requiring replacement of the entire assembly.

Consequently, there is a need for an applicator assembly that can easily handle very high throughput systems, without the need for frequent cleaning or replacement.

SUMMARY

In view of this need, an applicator assembly is provided for applying a liquid layer onto a surface movable relative to the applicator assembly. The assembly comprises a liquid supply, a distributor connected to the liquid supply for distributing the liquid, and an applicator having an area for receiving liquid from the distributor and an application edge. The distributor and the applicator configured so that liquid distributed on the area of the applicator forms a meniscus at the application edge. The application edge is positioned closely adjacent but not in contact with the surface. The application edge is at a distance sufficiently close to the surface so that the surface contacts the meniscus to withdraw liquid from the applicator onto the surface.

In another embodiment, a drum assembly in a printing or imaging machine comprises a rotating drum having a surface and an applicator assembly for applying oil onto the surface. The applicator assembly comprises a liquid supply containing a supply of oil, a distributor connected to the liquid supply for distributing the oil, and an applicator having an area for receiving oil from the distributor and an application edge. The distributor and the applicator are configured so that oil distributed on the area of the applicator forms a meniscus at the application edge. The application edge is positioned closely adjacent but not in contact with the surface of the drum at a distance sufficiently close to the surface So that the surface contacts the meniscus to withdraw oil from the applicator onto the surface.

DESCRIPTION OF THE EMBODIMENTS

Figure 1:
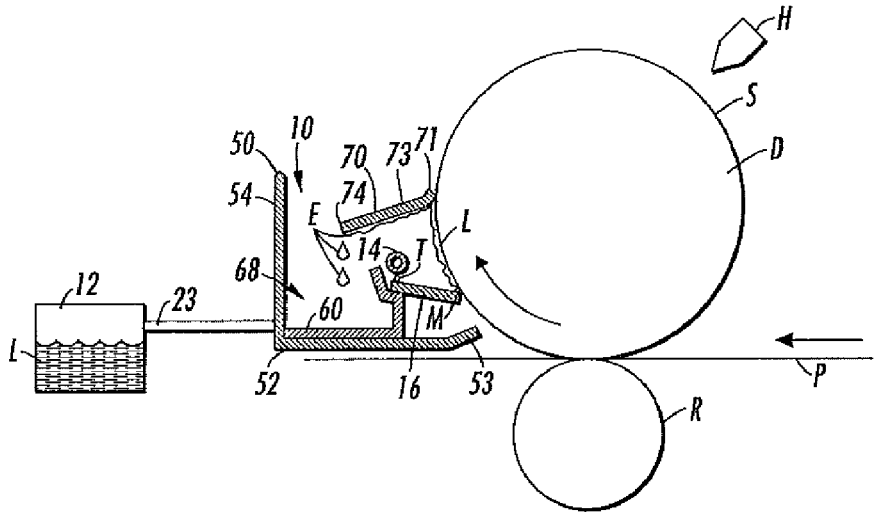
FIG. 1 is a side partial cross-sectional representation of an applicator assembly according to one embodiment used with a transfer imaging or printing machine.

As shown in FIG. 1, an applicator assembly 10 is provided for use with a rotating drum D, particularly to apply a layer of a liquid L onto the surface S of the drum. In one embodiment, the drum D is part of an imaging or printing machine utilizing a printhead H for applying an image onto the surface of the drum. A substrate, such as a sheet of paper P, passes between the drum D and a pressure roll R to transfer the image from the drum onto the surface of the substrate P. In one embodiment, the printhead H is a liquid ink jet that transfers ink droplets onto the surface S of the drum. In order to facilitate transfer of the image from the drum to the substrate P, a liquid intermediate transfer layer L of a release agent or oil layer L is applied to the surface S at a predetermined thickness. The image is thus transferred by the printhead H onto the liquid layer L, which ultimately facilitates release of the image onto the substrate.

The applicator assembly 10 includes a source 12 of the liquid or oil to be applied to the rotating drum. A distributor 14 is connected to the source and is operable to distribute a controlled quantity of oil at a controlled flow rate onto the applicator 16. The applicator 16 applies this controlled supply of oil onto the surface S of the drum. It can be appreciated that the applicator assembly is mounted within the imaging or print machine adjacent the drum D, which may be a transfer drum in an ink jet printing system, for instance. The position of the assembly 10 shown in FIG. 1 is merely exemplary, it being understood that other orientations of the apparatus relative to the substrate P or printhead H may be preferred.

The source 12 preferably includes a container 40 (FIG. 2) that contains a replenishable quantity of a release liquid or oil. The container may be equipped with components necessary to maintain the liquid contained therein in a condition suitable for immediate and continuous use by the applicator assembly 10. For instance, maintaining proper viscosity of the liquid/oil can be important to optimum performance of the applicator assembly 10, as well as of the release agent itself once applied to the rotating drum. In a specific embodiment, the container can hold a liquid volume of 1-5 gal.

Figure 2:
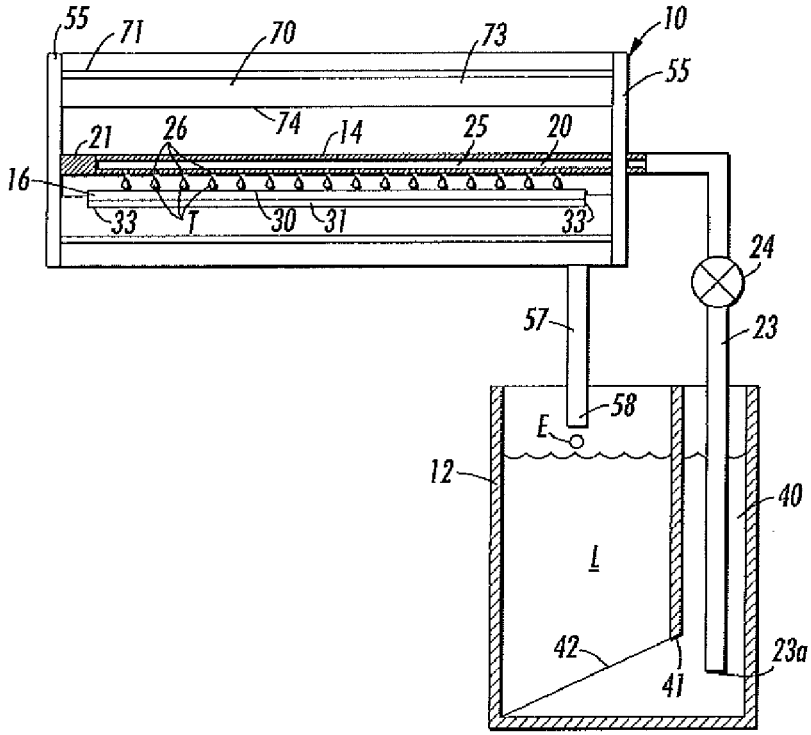
FIG. 2 is a front representation of the applicator assembly shown in FIG. 1.

In one embodiment, the distributor 14 includes a pipe 20 that is connected to the liquid source 12. As shown in FIG. 2, the pipe 20 is connected to a supply tube 23, with the intake end 23*a* of the tube immersed in the liquid within the container 40. A pump 24 is provided to pump liquid from the container into the pipe. In a specific embodiment, the pump is a piston diaphragm pump capable of flow rates from 10 gpm to 320 gpm for a typical release oil (for instance a silicone based material such as 10 cs Taipan Oil). The intake end 23*a* of the supply tube 23 is offset from the bottom of the container to provide space for solid contaminants or sediment to settle without risk of being drawn into the supply tube. Additional protection is provided by a weir wall 41 within the container 40 that separates the container into two volumes. A filter screen 42 separates the two volumes and provides an initial means for removing contaminants that may be suspended within the liquid L within the container 40.

The liquid L is pumped from the container 40 through the lumen 25 of the pipe 20 of the distributor 40. The pipe includes a capped end 21 so that all the liquid passing into the pipe is discharged through a plurality of apertures 26 distributed along the length of the pipe. In accordance with one feature of the illustrated embodiment, the apertures are sized to achieve a calibrated drip rate. In particular, the liquid is discharged from the distributor pipe 20 in drops T onto the surface 26 of the applicator 16. As shown in FIGS. 1-5, the applicator 16 in this embodiment is in the form of an elongated blade 30 that is supported in a position parallel to the rotating drum D. As shown in detail in FIG. 4, the drops T discharged from the pipe 20 fall onto an area 35 of the applicator blade 30. The blade is oriented at an angle so that gravity causes the drops of liquid to flow toward the application edge 31 of the blade, forming a film F of liquid on the surface 36 of the blade.

In one aspect of the applicator assembly 10, the angle of the blade 30 is calibrated relative to the viscosity of the liquid L so that the liquid film F forms a meniscus M at the application edge 31 of the blade. In other words, the properties of the liquid, namely the surface tension, allows an amount of liquid to collect at the edge 31 without spilling over the edge. Surface tension in the film F along with surface adherence between the film F and the surface 36 of the blade 30 control the flow of the film toward the edge 31. The configuration and orientation of the blade 30 thus takes advantage of the fluid properties of the liquid/oil to provide a continuously sustained meniscus M along the entire length of the application edge 31. This length of the edge 31 is sized to span a predetermined portion of the length of the drum D, but particularly to span the length of the drum across which the image is formed by the printhead H.

Figure 3:
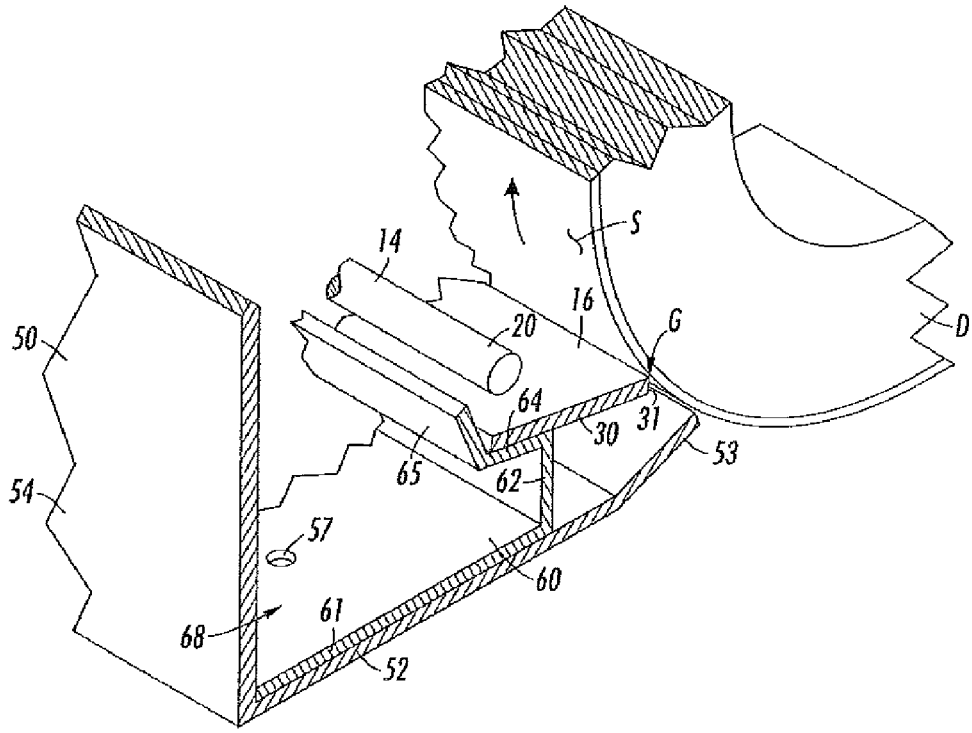
FIG. 3 is an end perspective partial cross-sectional view of the applicator assembly shown in FIG. 1.
Figure 4:
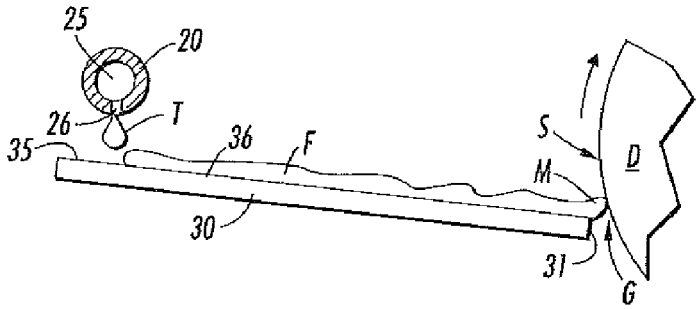
FIG. 4 is an end detail view of the distributor and applicator components of the assembly shown in the previous figures.

In another aspect of the assembly 10, the edge 31 of the blade does not contact the drum surface S, but is instead offset from the surface by a gap G (FIGS. 3-4). As shown in FIG. 4, this gap G is sized so that the meniscus M contacts the surface S of the rotating drum D. Thus, while the blade does not contact the drum, the liquid being dispensed by the applicator assembly is maintained in direct contact with the drum so that the liquid layer L can be applied. The gap G is sufficiently narrow so that the surface tension of the liquid will maintain the meniscus M even as liquid is drawn off the blade and onto the surface S of the drum D.

It is contemplated in some specific embodiments, that oil is supplied to the surface S of the drum D at a rate of 50 ml/min. For a standard silicone-based release agent the gap G is approximately 0.5 mm. The apertures 26 of the distributor pipe 20 are sized to achieve the desired flow rate across the blade 30. In a preferred embodiment, the apertures are sized as "weep" holes to produce controlled drops T of the liquid, rather than a continuous flow of liquid. As the drops T fall onto the surface 36 of the blade, they are spread by gravity into the film F, with the thickness of the film dictated by the fluid properties of the liquid. The film F is continuously replenished by a new drop T from the pipe 20 as the liquid is drawn from the meniscus M at the application edge 31.

The liquid flow rate may be controlled by the pump 24. When the drum D is inactive the pump may be deactivated. If the drum D is capable of variable rotational speeds, the pump too may be capable of producing variable flow rates to maintain a constant uniform meniscus M at the application edge 31.

In one embodiment, the apertures are uniformly distributed along the length of the pipe, corresponding to a uniform distribution along the length of the blade. The distribution of the apertures 26 is determined by the amount that the drops T spread across the length of the blade as they form the film F on the surface 36. In a specific embodiment, the apertures 26 may be spaced at 1 cm intervals.

Figure 5:
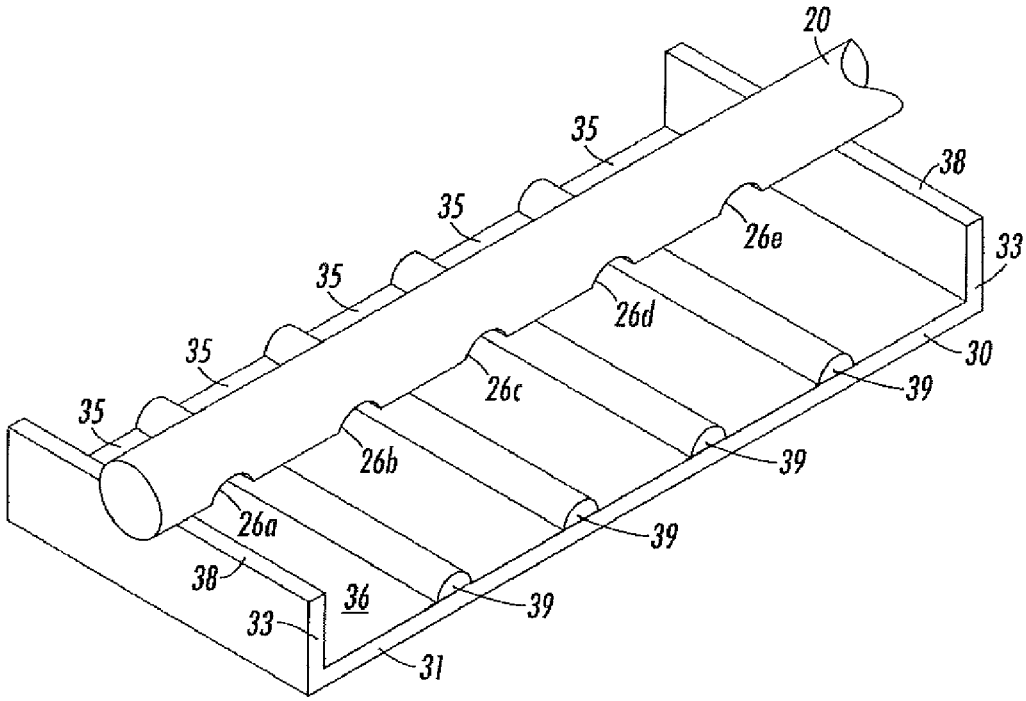
FIG. 5 is a top perspective view of one embodiment of the distributor and applicator components of the assembly shown in the previous figures.

In one embodiment, the diameter of the weep apertures 26 decreases from the inlet end of the pipe 20 to the capped end 21. This decrease in diameter ensures a uniform flow of liquid through each aperture 26 even as the pressure head increases within the pipe toward the capped end. In a specific embodiment, the weep aperture diameters may decrease from 4 mm at the inlet end to 2 mm at the capped end, as depicted in FIG. 5. It is understood that while the pipe 20 in FIG. 5 is shown with only five apertures 26*a*-26*e*, other embodiments may include a greater number of apertures, as shown in FIG. 2.

In certain embodiments the blade 30 may incorporate flow control elements to control the flow of the liquid or oil along the length of the blade. For instance, although the applicator assembly 10 is ideally installed within the printing machine so that the blade is level from end to end, the printing machine itself may not sit level on the support surface. In that instance, the gravity-induced flow of the liquid will not only follow the angle of the blade 30 toward the drum D, but also the non-horizontal angle of the blade along its longitudinal axis. In order to prevent the oil from dripping off the ends of the blade, flow control elements 38 may be provided at each longitudinal end of the blade, as shown in FIG. 5. The flow control elements 38 may be in the from of a raised lip that is at least taller than the film F of liquid that forms on the surface 36 of the blade, and preferably taller than the height of the meniscus M.

In an alternative embodiment, intermediate flow control elements 39 may also be provided on the surface 36 of the blade 30. These flow control elements 39 may be interspersed between the locations of the weep apertures, such as the exemplary apertures 26*a*-26*e* shown in FIG. 5. The intermediate elements 39 will thus contain the liquid dripping from a corresponding aperture to ensure a uniform distribution along the application edge 31. It is contemplated that the intermediate flow control elements terminate short of the application edge 31 so that the liquid may form a continuous, unbroken meniscus bead M across the length of the edge 31. In a preferred embodiment, each intermediate elements 39 is in the form of a raised ridge having a height at least greater than the thickness of the liquid film F.

As thus far described, the applicator assembly 10 functions to apply a liquid layer L onto the surface S of the drum D as it rotates relative to the assembly 10. The drum D contacts only the meniscus M and not the blade 30 as it traverses the assembly. The assembly is configured to provide a uniform flow of liquid/oil to the application edge 31 to form continuous and uniform meniscus bead M. However, in practice the liquid layer L deposited on the surface S of the drum D will not be completely uniform. It is thus contemplated that the applicator assembly 10 is configured to provide a layer L that is thicker than necessary for the transfer functions of the layer. The applicator assembly includes a wiper blade 70 (FIGS. 1-2) situated downstream of the applicator blade 30 (relative to the direction of rotation of the drum D). The wiper blade may be of conventional construction for metering off excess oil E from the surface S of the drum D. Thus, in one specific embodiment, the wiper blade 70 is a urethane blade of 70 Shore A durometer, having a thickness of 2 mm and a free length of 7 mm. The wiper blade contacts the drum surface with a contact force and contact area 71 calibrated to achieve a predetermined thickness of the liquid layer L. In certain embodiments, the blade contact area is about 2 mm and the contact force is 35-70 N.

As is known in the art, the excess liquid E drawn from the surface by the contact area 71 will follow the transfer surface 73 at the underside of the wiper blade 70. The excess liquid will follow the surface to the discharge end 74 where the liquid falls by gravity.

In accordance with a further feature, the applicator assembly 10 includes structure to collect and recycle the excess liquid E drawn off the drum surface by the wiper blade 70. As shown in FIGS. 1-3, the assembly 10 includes a containment tray 50 that defines a collection reservoir 68 for collecting the excess liquid E. The containment tray supports not only the wiper blade 70 but also the applicator blade 30. The tray includes a bottom wall 52 that defines a drip plate 53 that projects beyond the applicator blade 30 toward the drum D. The drip plate 53 is arranged to collect any liquid that drips over the application edge 31 of the blade 30.

As shown particular in FIGS. 1 and 3, the containment tray 50 is open facing the drum D, with the applicator blade 30 and wiper blade supported to extend from that opening. The applicator blade is supported on a containment bracket 60. The bracket includes a base 61 that is attached to the bottom wall 52 of the tray 50. The bracket further includes a containment wall 62 that together with bottom wall 52, back wall 54, and end walls 55 (FIG. 2) define the collection reservoir 68. The bracket forms a blade support 64 onto which the applicator blade 30 is mounted. As seen in the figures, the blade support is angled to support the applicator blade at a predetermined angle. In a specific embodiment, the support 64 holds the blade at an angle of 5-10° relative to the horizontal, although other angles are contemplated with appropriate changes to the structure of the blade support. The bracket further defines a splash wall 65 that provides a back face for positioning the applicator blade 30 as well as for containing the liquid drops T dispensed from the distributor pipe 20.

As shown in FIGS. 1 and 3, the containment bracket 60 may be provided as a separate component that is sealably attached to the bottom wall 52 and end walls 55 of the containment tray. Alternatively, the bracket 60 may be formed as one piece with the bottom wall 52 of the tray, such as in a common extrusion.

The end walls 55 not only complete the enclosure for the collection reservoir, they may also provide support for the distributor pipe 20 as well as the wiper blade 70, as shown in FIG. 2. The distributor pipe 20 may extend through openings in one or both end walls 55. The wiper blade 70 may be attached to the end walls 55 in any manner, such as by a bracket or by engagement within a groove formed in the end walls.

As shown in FIG. 2, the containment tray includes a drain tube 57 that extends through the bottom wall 52 and base 61 of the containment bracket 60, and into the collection reservoir 68. The bottom wall and base may be configured to funnel the excess liquid E toward the drain tube 57. The discharge end 58 of the drain tube 57 empties into the container 40 of the liquid source 12. The excess liquid E is thus recycled into the liquid supply for re-use. It is anticipated that the recycled liquid E may pick up debris from the surface S of the drum D and that this debris will find its way into the liquid source. Thus, the filter screen 42 and sediment trap is provided within the container, as described above.

In certain embodiments, the transfer blade 30 has a length that is less than the length of the drum D, but at least equal to the length of the image area on the drum. On the other hand, the wiper blade 70 has a length that may be greater than the length of the drum. Preferably, the wiper blade has a length greater than the length of the applicator blade, to prevent liquid from walking around the ends of the wiper blade and depositing large amounts of liquid on the substrate P. The wiper blade may extend at least 4 mm, and up to 10 mm, beyond the ends of the applicator blade.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

For instance, in the illustrated embodiments, the surface S on which the liquid layer is applied is on a cylindrical rotating drum. Alternatively the surface may be on a belt so that the surface is generally linear as it passes by the applicator assembly 10.

What is claimed is:

1. An applicator assembly for applying a liquid layer onto a surface, the assembly and the surface movable relative to each other, the applicator assembly comprising:

a liquid supply;

an elongated tube connected to said liquid supply, the elongated tube having a plurality of apertures for distributing the liquid received from the liquid supply;

an elongated blade positioned adjacent said elongated tube to receive the liquid passed through the plurality of apertures in the elongated tube, the elongated blade having an application edge, a long axis, a length along said axis, and an area for receiving the liquid distributed from said elongated tube;

said elongated tube and said elongated blade being configured to enable liquid distributed on said area of said elongated blade to form a meniscus at said application edge, and said application edge is positioned closely adjacent but not in contact with the surface at a distance sufficiently close to the surface so that the surface contacts the meniscus to withdraw liquid from said elongated blade onto the surface.

2. The applicator assembly according to claim 1, wherein said elongated blade includes opposite ends and a flow control element at each of said opposite ends extending from said application edge toward said area and configured to prevent fluid from flowing thereacross beyond said opposite ends.

3. The applicator assembly according to claim 1, wherein said apertures are sized to distribute the liquid in continuous drops onto said elongated blade.

4. The applicator assembly according to claim 3, wherein:

said elongated tube is connected at one end to said liquid supply and is capped at an opposite end; and said plurality of apertures are spaced along the length of said elongated tube and decrease in diameter relative to each other from said one end to said opposite end.

5. The applicator assembly according to claim 4, wherein said plurality of apertures are substantially uniformly spaced along the length of said elongated tube.

6. The applicator assembly according to claim 1, wherein said elongated blade includes a flow control element extending from said application edge to at least adjacent said area, arranged between successive ones of said plurality of apertures in said elongated tube and configured to prevent fluid from flowing thereacross.

7. The applicator assembly according to claim 6, wherein said elongated blade includes opposite ends and a flow control element at each of said opposite ends extending from said application edge toward said area and configured to prevent fluid from flowing thereacross beyond the opposite ends.

8. The applicator assembly according to claim 1, further comprising a wiper blade offset from said elongated blade along the direction of relative movement between the surface and said applicator assembly, said wiper blade having a contact area arranged relative to the surface to remove excess liquid from the surface.

9. The applicator assembly according to claim 8, further comprising a containment tray, wherein said wiper blade is arranged to direct said excess liquid into said containment tray.

10. The applicator assembly according to claim 9, wherein said containment tray is connected to said liquid supply to direct said excess liquid thereto.

11. The applicator assembly according to claim 9, wherein said containment tray includes a bottom wall that extends beyond said application edge of said elongated blade.

12. The applicator assembly according to claim 9, wherein:

said containment tray is essentially trough-shaped with a trough opening, said tray including opposite end walls; and said wiper blade is supported by said opposite ends to extend through said trough opening.

13. The applicator assembly according to claim 12, wherein said wiper blade is supported at an angle so that excess liquid removed by said wiper edge flows along said wiper blade by gravity toward said containment tray.

14. The applicator assembly according to claim 8, wherein:

said wiper blade is arranged substantially parallel to said elongated blade and is longer than said elongated blade.

15. The applicator assembly according to claim 14, in which the surface has a length, wherein said wiper blade is longer than the length of the surface.

16. The applicator assembly according to claim 1, wherein said application edge of said elongated blade is arranged relative to said area so that the liquid distributed thereon flows by gravity to said application edge.

17. The applicator assembly according to claim 16, wherein:

said application edge extends substantially along the length of said elongated blade;

said area extends substantially along said length adjacent an edge of said elongated blade opposite said application edge; and said elongated blade is inclined from said opposite edge to said application edge.

18. The applicator assembly according to claim 1, further comprising a fluid pump operable to pump fluid under pressure from said liquid supply into said elongated tube.

19. A drum assembly in a printing machine comprising:

a rotating drum having a surface;

an applicator assembly for applying oil onto said surface, the assembly including;

a liquid supply containing a supply of oil;

an elongated tube connected to the liquid supply to distribute oil passing from the liquid supply through a plurality of apertures in the elongated tube;

an elongated blade positioned along said elongated tube to receive oil from the apertures in the elongated tube, the elongated blade having an application edge, a long axis, a length along said axis, and an area for receiving oil from said elongated tube, said application edge extends substantially along the length of said elongated blade, said elongated tube and said elongated blade being configured to enable oil distributed on said area of said elongated blade to form a meniscus at said application edge, and said application edge is positioned closely adjacent but not in contact with said surface of said rotating drum at a distance sufficiently close to said surface to enable said surface to contact the meniscus to withdraw oil from said elongated blade onto said surface.

20. The applicator assembly according to claim 19, wherein said elongated blade includes opposite ends and a flow control element at each of said opposite ends extending from said application edge toward said area and configured to prevent fluid from flowing thereacross beyond said opposite ends.

21. The applicator assembly according to claim 19, wherein said apertures are sized to distribute the oil in continuous drops onto said elongated blade.

22. The applicator assembly according to claim 21, wherein:

said elongated tube is connected at one end to said liquid supply and is capped at an opposite end; and said plurality of apertures are spaced along the length of said elongated tube and decrease in diameter relative to each other from said one end to said opposite end.

23. The applicator assembly according to claim 22, wherein said plurality of apertures are substantially uniformly spaced along the length of said elongated tube.

24. The applicator assembly according to claim 19, wherein said elongated blade includes a flow control element extending from said application edge to at least adjacent said area, arranged between successive ones of said plurality of apertures in said elongated tube and configured to prevent oil from flowing thereacross.

25. The applicator assembly according to claim 24, wherein said elongated blade includes opposite ends and a flow control element at each of said opposite ends extending from said application edge toward said area and configured to prevent oil from flowing thereacross beyond the opposite ends.

26. The applicator assembly according to claim 19, further comprising a wiper blade offset from said elongated blade along the direction of relative movement between said surface of said rotating drum and said applicator assembly, said wiper blade having a contact area arranged relative to said surface of said drum to remove excess oil from said surface.

27. The applicator assembly according to claim 26, further comprising a containment tray, wherein said wiper blade is arranged to direct said excess oil into said containment tray.

28. The applicator assembly according to claim 27, wherein said containment tray is connected to said liquid supply to direct said excess oil thereto.

29. The applicator assembly according to claim 27, wherein said containment tray includes a bottom wall that extends beyond said application edge of said elongated blade.

30. The applicator assembly according to claim 27, wherein:

said containment tray is essentially trough-shaped with a trough opening, said tray including opposite end walls; and said wiper blade is supported by said opposite ends to extend through said trough opening.

31. The applicator assembly according to claim 30, wherein said wiper blade is supported at an angle so that excess oil removed by said wiper edge flows along said wiper blade by gravity toward said containment tray.

32. The applicator assembly according to claim 26, wherein:

said wiper blade is arranged substantially parallel to said elongated blade and is longer than said elongated blade.

33. The applicator assembly according to claim 32, wherein said surface of said drum has a length and said wiper blade is longer than the length of said surface.

34. The applicator assembly according to claim 19, wherein said application edge of said elongated blade is arranged relative to said area so that the oil distributed thereon flows by gravity to said application edge.

35. The applicator assembly according to claim 34, wherein:

said application edge extends substantially along the length of said elongated blade;

said area extends substantially along said length adjacent an edge of said elongated blade opposite said application edge; and said elongated blade is inclined from said opposite edge to said application edge.

36. The applicator assembly according to claim 19, further comprising a fluid pump operable to pump fluid under pressure from said liquid supply into said elongated tube.

* * * * *